US005782382A

United States Patent [19]

Van Marcke

[11] Patent Number: 5,782,382

[45] Date of Patent: Jul. 21, 1998

[54] DISPENSER FOR PERSONAL HYGIENE LIQUIDS

[75] Inventor: Karel Carl Van Marcke, Kruishoutem, Belgium

[73] Assignee: International Sanitary Ware Manufacturing CY, Belgium

[21] Appl. No.: 578,080

[22] Filed: Dec. 27, 1995

[51] Int. Cl.[6] ..... B67D 5/08

[52] U.S. Cl. ..... 222/52; 222/58; 222/81; 222/105; 222/160

[58] Field of Search ..... 222/52, 1, 58, 222/64, 81, 105, 160, 162; 141/351

[56] References Cited

U.S. PATENT DOCUMENTS

| | | | |
|---|---|---|---|
| 2,074,554 | 3/1937 | Myron . | |
| 2,771,878 | 11/1956 | Folland et al. | 222/58 X |
| 2,986,142 | 5/1961 | Bieberdorf et al. | 222/81 X |
| 3,033,248 | 5/1962 | Ritchie | 141/351 |
| 3,273,752 | 9/1966 | Horeczky | 222/52 |
| 3,434,628 | 3/1969 | Ceraldi | 222/52 |
| 3,452,361 | 6/1969 | Williams, Jr. | 222/58 X |
| 3,455,487 | 7/1969 | Crippen et al. | 222/76 |
| 3,843,020 | 10/1974 | Bardeau et al. | 222/129.1 X |
| 3,991,912 | 11/1976 | Soto | 222/81 X |
| 4,008,830 | 2/1977 | Meshberg | 222/95 |
| 4,008,831 | 2/1977 | Vidilles | 222/95 |
| 4,261,356 | 4/1981 | Turner et al. | 128/214 R |
| 4,375,864 | 3/1983 | Savage | 222/81 |
| 4,455,139 | 6/1984 | Gordon et al. | 222/58 X |
| 4,484,697 | 11/1984 | Fry, Jr. | 222/95 |
| 4,527,716 | 7/1985 | Haas et al. | 222/83.5 |
| 4,645,094 | 2/1987 | Acklin et al. | 222/52 |
| 4,863,066 | 9/1989 | Uffenheimer et al. | 222/1 |
| 4,938,421 | 7/1990 | Berfield et al. | 239/309 |
| 4,941,219 | 7/1990 | Van Marcke | 4/623 |
| 4,946,072 | 8/1990 | Albert et al. | 222/105 |
| 4,956,883 | 9/1990 | Lane | 4/605 |
| 4,998,850 | 3/1991 | Crowell | 406/48 |
| 5,004,158 | 4/1991 | Halem et al. | 239/310 |
| 5,086,526 | 2/1992 | Van Marcke | 4/623 |
| 5,178,300 | 1/1993 | Haviv et al. | 222/95 |
| 5,188,261 | 2/1993 | Butters | 222/107 |
| 5,195,655 | 3/1993 | Bukham | 222/1 |
| 5,215,216 | 6/1993 | Van Marcke | 222/1 |
| 5,217,035 | 6/1993 | Van Marcke | 137/1 |
| 5,251,787 | 10/1993 | Simson | 222/95 |
| 5,316,196 | 5/1994 | Reich | 222/160 |
| 5,566,732 | 10/1996 | Nelson | 141/351 X |

FOREIGN PATENT DOCUMENTS

| | | | |
|---|---|---|---|
| 0127497 | 12/1984 | European Pat. Off. . | |
| 575738 | 1/1924 | France . | |
| 2701646 | 2/1993 | France . | |
| 39510 | 10/1913 | Sweden | 222/160 |
| 288335 | 12/1971 | U.S.S.R. | 222/160 |
| 1224592 A | 4/1984 | U.S.S.R. . | |
| 623087 | 5/1949 | United Kingdom . | |

OTHER PUBLICATIONS

Copy of European Search Report dated Apr. 9, 1997 (2 pages) re application No. EP 96–20–3617.

*Primary Examiner*—Kevin P. Shaver

*Attorney, Agent, or Firm*—Cahill, Sutton & Thomas P.L.C.

[57] ABSTRACT

A vertically movable container for dispensing a liquid from an outlet in response to gravity is raised as a function of the depletion of the liquid to maintain the hydrostatic pressure at the outlet essentially constant and to provide a constant rate of outflow. A selectively operated on/off valve controls the flow from the container.

37 Claims, 3 Drawing Sheets

DISPENSER FOR PERSONAL HYGIENE LIQUIDS

BACKGROUND OF THE INVENTION

1. Field of the Invention

The present invention relates to dispensers for personal hygiene liquids and, more particularly, to gravity fed liquid dispensers having a constant flow rate.

2. Description of Related Art

Gravity fed liquid dispensers suffer from a common problem of diminishing flow rate as a function of the lowering fluid level within the dispenser. One technique for solving this problem is set forth in the Acklin patent, U.S. Pat. No. 4,645,094. Herein, liquid soap is disposed within a flexible container. Outflow of the liquid soap is provided by a conduit defining an outlet and a valve controls flow through the conduit. The flow rate of the liquid soap through the outlet is maintained by applying pressure to the container. In particular, apparatus is provided for gradually increasing the pressure on the container as the container is gradually emptied. The apparatus includes a pressure plate and a spring acting through a specially designed lever mechanism to gradually increase the force exerted by the pressure plate upon the container.

The Acklin device is suitable for many applications but it incorporates certain drawbacks. To operate it, a flexible, collapsible container must be used to permit the pressure plate to decrease the volume in the container to expel the liquid soap. As the pressure upon the container increases, a risk of leakage through a seam or seal, such as the seal attendant the conduit extending from the container, is increased. Moreover, bursting of the container is also a possibility.

SUMMARY OF THE PRESENT INVENTION

The present invention relates to a dispenser for personal hygiene liquids, such as liquid soap, having a container for the liquid situated at a first height. An outlet for the liquid is situated at a second height below the container and lower than the first height. A conduit allows flow of the liquid from the container to the outlet in response to the hydrostatic pressure of the liquid and a valve controls the flow of the liquid through the outlet. To initiate flow through the conduit, apparatus for drawing the liquid through the conduit to the valve is disclosed. By raising the height of the container as a function of depletion of the liquid from the container the level of the liquid can be maintained essentially constant at the first height. The constant height of the liquid level relative to the outlet will maintain the hydrostatic pressure constant and provide an essentially constant rate of flow through the outlet when the valve is open.

It is therefore a primary object of the present invention to provide an essentially constant flow rate of fluid through an outlet of a liquid dispenser.

Another object of the present invention is to maintain constant the effective hydrostatic pressure at the outlet of a gravity fed liquid dispenser by raising the elevation of a container containing the liquid as an inverse function of the degree of fill of the container.

Yet another object of the present invention is to provide apparatus for altering the height of a container of liquid to be dispensed through an outlet in order to keep the rate of outflow essentially constant during depletion of the liquid to be discharged.

Yet another object of the present invention is to provide a gravity feed apparatus useable with rigid or collapsible liquid containers to dispense the liquid at an essentially constant rate despite a lowered level of the liquid within the container.

A further object of the present invention is to provide a gravity feed apparatus for raising on a continuing basis the height of a container containing liquid to be dispensed as a function of the quantity of liquid dispensed.

A yet further object of the present invention is to provide apparatus for raising the height of a liquid dispensing container as a function of the quantity of liquid dispensed to maintain the outflow rate essentially constant.

A still further object of the present invention is to provide apparatus for receiving prefilled replacement liquid filled containers to dispense the liquid through a needle penetrably inserted through a wall of the container and an attached conduit at a constant flow rate by increasing the height of the container as a function of the depletion of the liquid.

A still further object of the present invention is to provide a method for using gravity to dispense liquid from a container at a constant flow rate during depletion of the liquid from the container.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DETAILED DESCRIPTION OF THE PREFERRED EMBODIMENT

Figure 1:
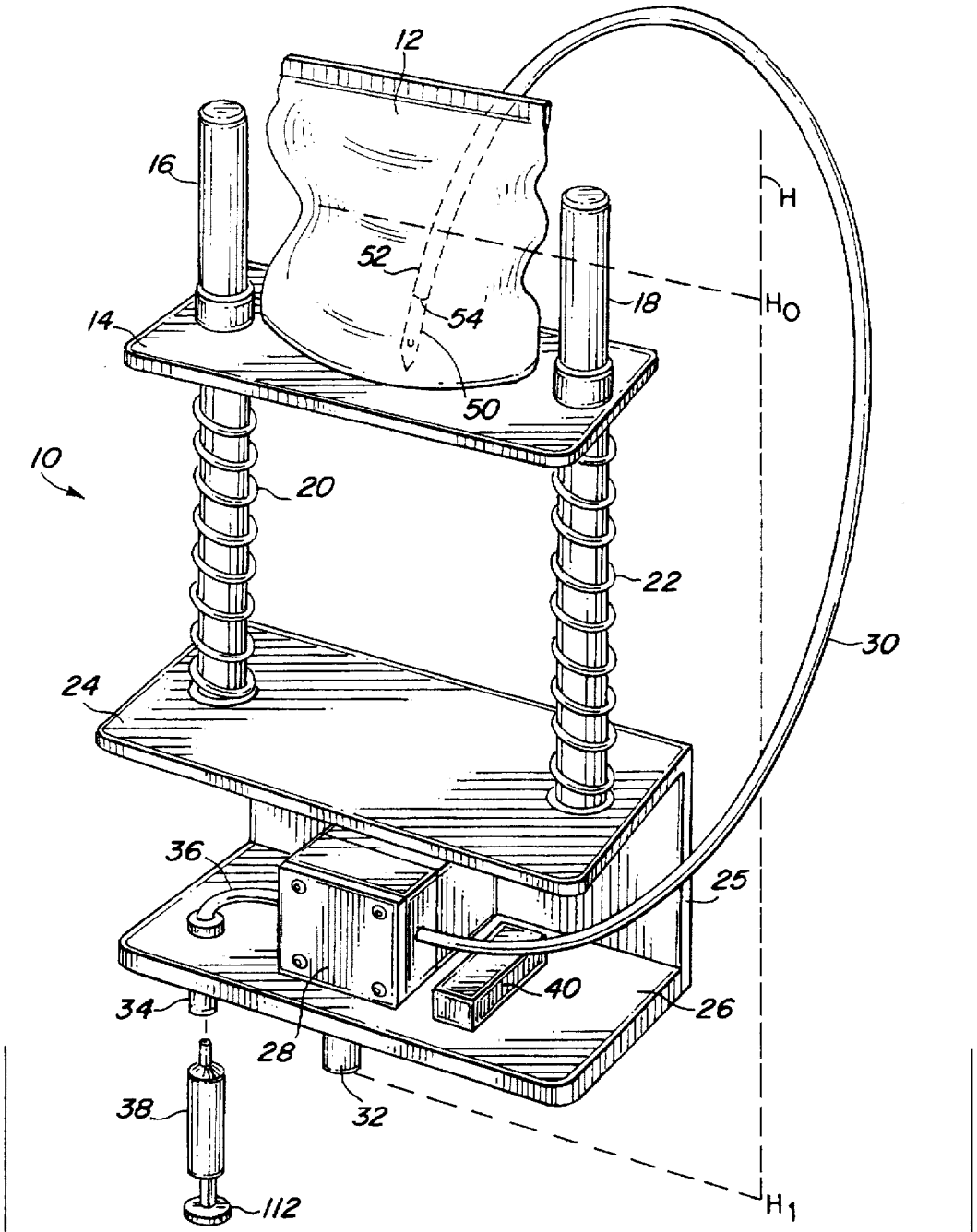
FIG. 1 is a representative perspective view of the present invention.

Referring to FIG. 1, there is illustrated a dispenser 10 for dispensing a personal hygiene liquid, such as liquid soap, shampoo, hair conditioner, etc. Other liquids for various purposes can also be dispensed through use of dispenser 10. For discussion purposes, it will be assumed that the liquid to be dispensed is liquid soap for personal hygiene purposes.

Dispenser 10 includes a container 12 essentially filled with liquid soap and disposed upon a shelf 14, which may be any type of support or supporting element. The shelf is vertically slidably mounted upon a pair of stanchions or posts 16,18. A pair of compressible coil springs 20,22 are mounted about posts 16,18, respectively, to support shelf 14 at a height commensurate with the weight of container 12 and the spring force exerted by the springs. Posts 16 and 18 are mounted upon a pedestal 24. A platform 26 depending from pedestal 24 by plate 25 supports a valve 28 for controlling fluid flow through conduit 30 and fluid discharge through outlet 32. To initiate flow from a filled container 12, a conduit fill valve 34, mounted upon platform 26, may be employed. The fill valve is in fluid communication with conduit 30 via a further conduit 36. A syringe 38, or other device interconnecting with valve 34 for the purpose of drawing fluid through conduit 30 into valve 28, may be employed.

Container 12 may be a rigid container having an outlet for interconnection with conduit 30. Alternatively, and preferably, container 12 is a closed flexible container without an outlet and filled with the liquid to be dispensed. Access to the liquid within the container may be accomplished by a hollow needle 50 mechanically attached to and in fluid communication with end 52 of conduit 30. If container 12 is of the type described in a patent application entitled "SOAP BAG", incorporated herein by reference, Ser. No. 08/580,425, filed Dec. 27, 1995, now U.S. Pat. No. 5,791,519, and as shown in FIG. 1, needle 50 is brought into penetrable engagement with a wall 54 of the container. The characteristics of the wall of the container will form a seal about the circumference of the needle to prevent leakage about the needle. Thus, the liquid contents of container 12 may be discharged through needle 50 into conduit 30 in response to opening of valve 28 and liquid outflow through outlet 32.

The use of such a filled flexible container permits replacement of the container by simply withdrawing needle 50 from the exhausted container and inserting the needle through the wall of a replacement container. This procedure essentially prevents spillage of the liquid during container replacement and is easily performable by maintenance personnel.

Once conduit 30 is filled, and when valve 28 is open, the flow rate of discharged liquid is a function of two factors. First, the hydrostatic pressure or head pressure at outlet 32 is a function of the difference in height between first height $H_0$ of the level of the liquid within container 12 and second height $H_1$ of outlet 32. As the liquid within the container is depleted, the level of the liquid will drop to a height below height $H_0$. With such drop in level and commensurate reduction in height difference, the head pressure will be reduced with a commensurate effect upon the flow rate. To maintain the flow rate constant, it is necessary to maintain the level of the liquid essentially constant at height $H_0$ despite depletion of liquid within container 12.

As the quantity of liquid within container 12 is reduced, the weight of the container is commensurately reduced. This change in weight provides a reduced compressive force upon supporting springs 20 and 22 via shelf 14 resulting in extension of the springs commensurate with the reduced weight of the container. Upon extension of the springs, shelf 14 will be raised and the level of the liquid within container 12 will be raised. By matching springs 20,22 with the weight of container 12 to cause the container to be raised a height equivalent to the lowered level of the liquid within the container from a full to an empty container, the liquid level within the container is retained essentially at height $H_0$ during depletion of the liquid. Thereby, the hydrostatic force or head pressure causing flow of liquid through conduit 30 and discharged through outlet 32 will remain essentially constant irrespective of the extent of depletion of liquid from within container 12.

Instead of being supported by springs 20,22, the shelf may be suspended from one or more coil springs or other spring-like elements. The operation of such suspension system would be identical to that described above. That is, as the weight of the container is reduced, the suspending spring(s) would contract to raise the container and thereby maintain the level of the liquid essentially constant. Of course, the spring rate of the suspension spring(s) would be selected commensurate with the weight and change in weight of the container.

Figure 2:
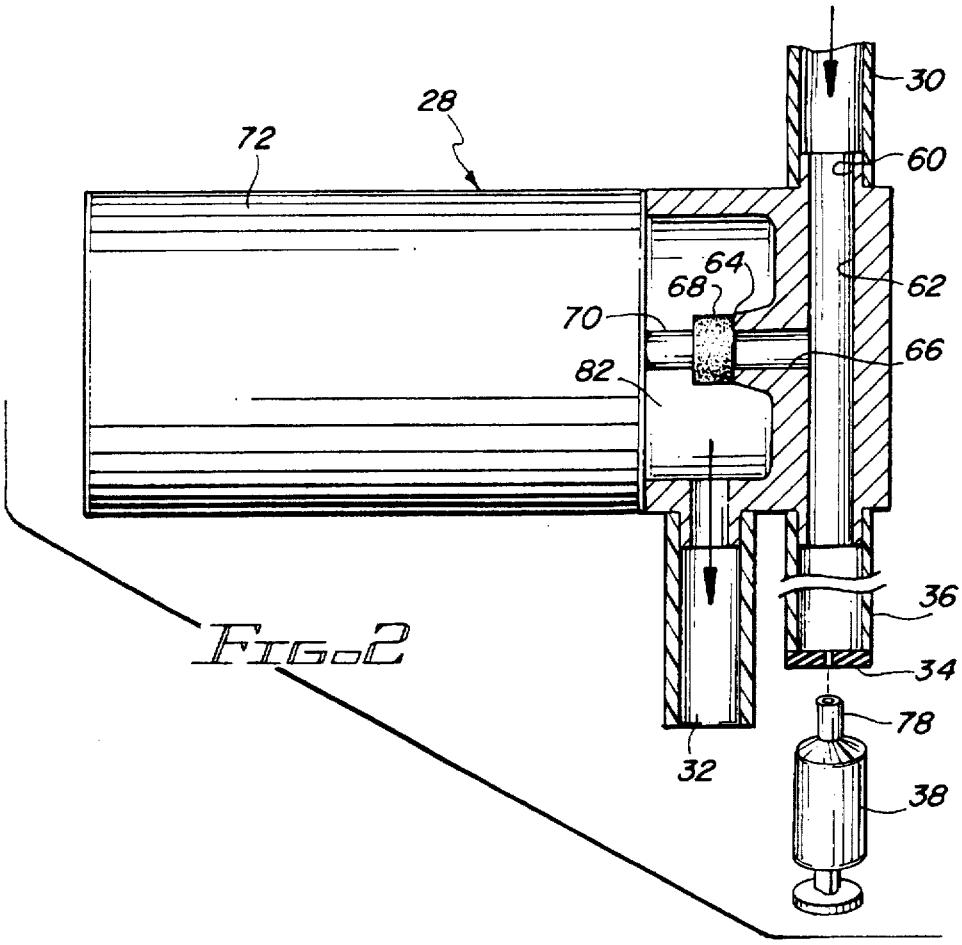
FIG. 2 illustrates a valve for controlling the flow rate and apparatus for initiating outflow from a filled container.

Referring to FIG. 2, there is shown a partial cross-sectional view of valve 28. Conduit 30 is secured to inlet 60 of passageway 62. Outlet 64 of branch passageway 66, in fluid communication with passageway 62, is selectively closed by a seal member 68 disposed at the end of plunger 70. Plunger 70 is the operative element of a solenoid valve 72, which valve may be a latching valve that requires no current to operate except during a change of state of plunger 70. Passageway 62 extends into a conduit 36, which may be a flexible conduit. Fill valve 34 (shown representatively) at the terminal end of conduit 36 prevents outflow and yet accommodates insertion of nozzle 78 of a syringe 38. Outlet 64, when not closed by seal member 68, evacuates liquid into an encircling chamber 82. Outlet 32 is in fluid communication with chamber 82 to permit flow of liquid from within the chamber through the outlet.

Figure 3:
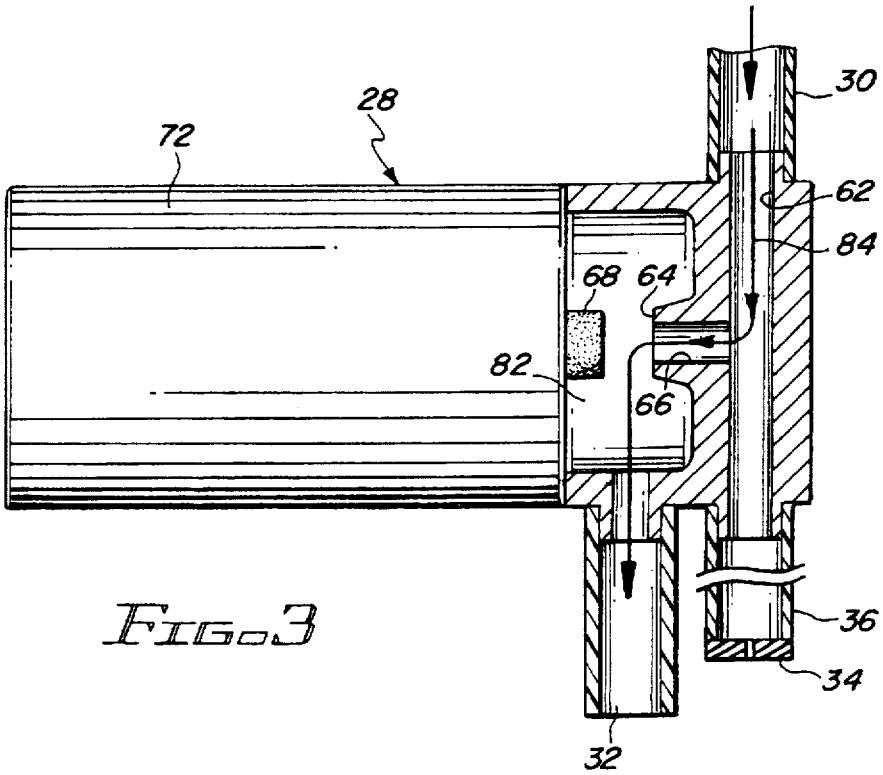
FIG. 3 illustrates the flow controlling valve in the open state.

As depicted by arrow 84 in FIG. 3, once flow of liquid enters valve 28 through conduit 30, it flows into passageway 62, branch passageway 66, through outlet 64 and into chamber 82 for discharge through outlet 32. The discharge will continue for as long as seal member 68 is retracted by plunger 70 as a result of actuation of solenoid 72. To halt further flow of fluid, an appropriate electrical signal is transmitted to solenoid 72 to extend plunger 70 and position seal member 68 adjacent outlet 64 to close the outlet.

Figure 4B:
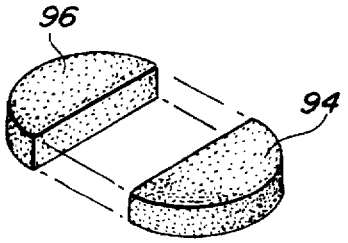
FIG. 4*b* illustrates two flexible elements of the valve shown in FIG. 4*a;*
Figure 4C:
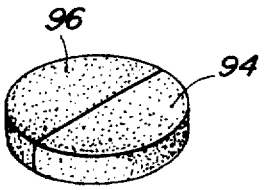
FIG. 4*c* illustrates the two flexible elements of the valve shown in FIGS. 4*a* and 4*b* in an abutting relationship.
Figure 4A:
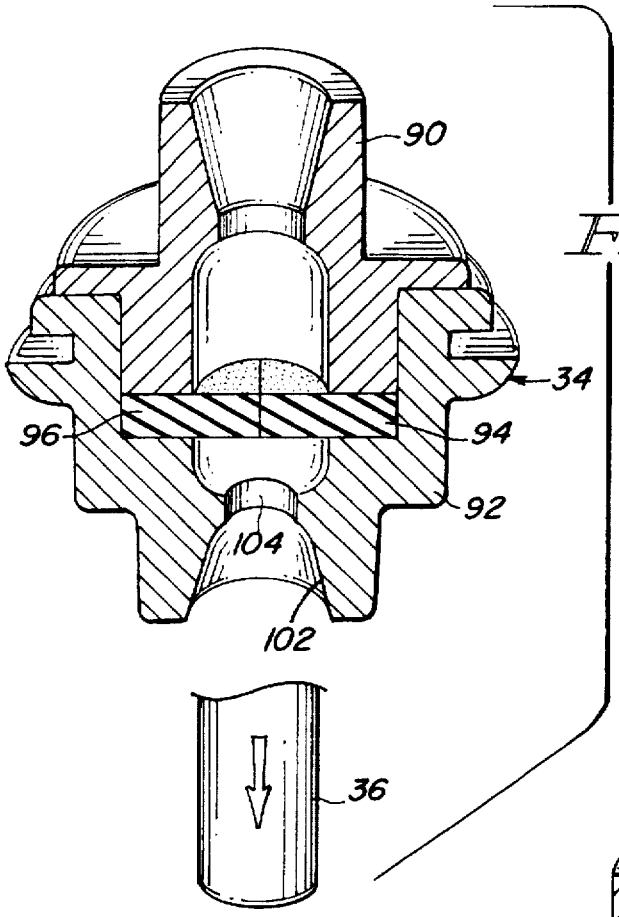
FIG. 4*a* illustrates a valve in the closed state for accommodating initiation of flow of liquid from a container.

Referring to FIG. 4*a*, there is illustrated a detailed partial cutaway view of valve 34. The valve includes a fitting 90 engaging the end of conduit 36. A cap 92 is attached to fitting 90 for the purpose of retaining a pair of flexible opposed rubber membranes or sealing elements 94,96 in place. These sealing elements may be in the shape of two semicircular, elastomeric, flexible planar elements, as depicted in FIG. 4*b*. When in position, elements 94,96 abut one another, as depicted in FIG. 4*c* and form a seal at the junction. The mating of fitting 90 in cap 92 provides a seal adjacent the circular perimeter of abutting elements 94,96. Thereby, elements 94,96 of valve 34 preclude outflow through valve 34.

Figure 5:
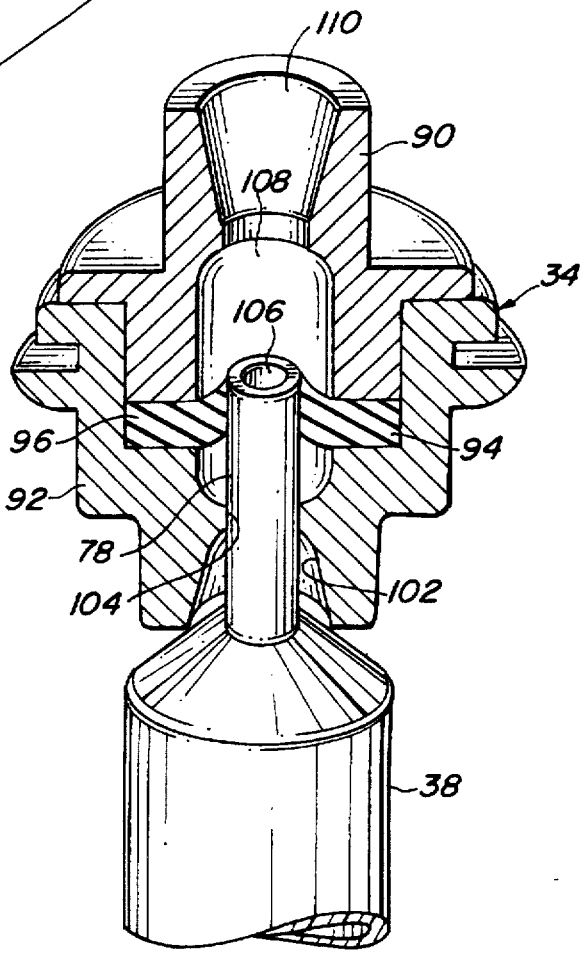
FIG. 5 illustrates the valve shown in FIG. 4*a* in the open state and related apparatus for initiating flow of liquid from the container.

Referring to FIG. 5, there is illustrated apparatus for initially drawing fluid into and through conduit 30 to valve 28. Nozzle 78 of syringe 38 is inserted through entryway 102 at the lower end of cap 92. The entryway may include an annular sealing element 104 for encircling nozzle 78 upon penetration of the nozzle to prevent leakage of the liquid therepast. Further, penetrable insertion of the nozzle forces the abutting edges of elements 94,96 upwardly and apart from one another (see also FIGS. 4*a*, 4*b*, and 4*c*) to bring inlet 106 of nozzle 78 into fluid communication with the interior of conduit 30 through chamber 108 and entryway 110 adjacent the end of the conduit 36. Upon withdrawal of plunger 112 (see FIG. 1) of syringe 38, a below ambient pressure environment is formed within chamber 108 and entryway 110. The resulting low pressure is translated through conduit 36 into conduit 30. The atmospheric pressure acting upon container 12 and being greater than the reduced pressure within conduit 30 will compress the container to force liquid through needle 50 into the conduit. Such flow will quickly fill the conduit, passageway 62, branch passageway 66, and conduit 36. (See FIGS. 2 and 3). The resulting liquid flow from conduit 36 into chamber 108 may flow intermediate elements 94 and 96 adjacent nozzle 100. However, seal 104 about nozzle 78 will preclude further outflow of the liquid. Upon withdrawal of nozzle 78, elements 94,96 will resume their former abutting relationship and provide a seal to prevent outflow of liquid from valve 34 through entryway 102. Upon actuation of valve 28 (see FIG. 3) liquid will flow past seal member 68 into chamber 82 and be discharged through outlet 32. Hydrostatic pressure (head pressure) present in conduit 30 will ensure discharge of liquid whenever valve 28 is open.

Actuation of valve 28 may be through use of a manual switch actuated by a user. Alternatively, it may be through use of an active or passive infrared sensor sensing the presence, movement or temperature change of a user, a user's hands, or other body part within a target volume. The target volume may be a volume commensurate with all or part of a wash basin or it may be a volume in proximity to outlet 32 or other element. If the sensor is a passive sensor, it will draw very little current. Sensors of the type useable herewith are described in any one of U.S. Pat. Nos. 4,941,219, 5,086,526, 5,215,216, and 5,217,035 incorporated by reference. By employing a latching solenoid valve 72, as described above, very little current consumption occurs since current is only drawn during a change of state of the valve. Thereby, battery operation for both a passive sensor and the latching valve is feasible and practical since such a battery need not be replaced for an extended period of time. The actuation/deactuation of valve 28 may be performed automatically for a predetermined period or as a function of the proximity of a user.

Referring to FIG. 1, there is illustrated a unit 40 intended to be representative of a sensor, such as a passive infrared sensor, for initiating and/or terminating outflow through outlet 32 by operation of valve 28, circuitry for actuating and deactuating valve 28, whether responsive to a sensor or other signal generating element and a power supply, such as a battery.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. A dispenser for a personal hygiene liquid comprising a container for the liquid, which liquid has a level situated at a first height, a liquid outlet situated at a second height lower than the first height, a conduit for allowing flow of liquid from said container to said liquid outlet in response to hydrostatic pressure of the liquid, said conduit comprising a flexible tube having one end inserted into said container for siphoning the liquid and including a sealable opening and means cooperating with said opening for drawing liquid into said flexible tube by creating a below atmospheric pressure environment within said conduit, and a valve for controlling the flow of liquid through said outlet, a support for movably supporting said container in the dispenser, resilient means for supporting said support and adapted to increase the height of said container to keep the liquid level at the first height during flow of liquid out of said container to keep the hydrostatic pressure at said outlet substantially constant.

2. The dispenser as set forth in to claim 1, wherein said resilient means is adapted to keep the level of the liquid at a substantially constant height.

3. The dispenser as set forth in claim 1, wherein said resilient means comprises at least one spring for supporting said support.

4. The dispenser as set forth in claim 1 wherein said container is a disposable flexible bag.

5. The dispenser as set forth in claim 1 wherein said conduit includes a hollow needle attached to said conduit and said container includes a wall for penetrable engagement by said needle.

6. The dispenser as set forth in claim 1 comprising means for automatically controlling the operation of said valve.

7. A dispenser for dispensing a liquid from a flexible sealed container through an outlet at a constant rate in response to the force of gravity irrespective of the fill of the container, said dispenser comprising in combination:

(a) a conduit in fluid communication with the outlet and having a hollow needle for penetrable engagement with the container to obtain fluid communication between the container and the outlet;

(b) an on/off valve for controlling the flow from the container to the outlet;

(c) a further valve for initially drawing fluid from the container through said needle and into said conduit; and (d) a support for supporting the container, said support including means for raising the container as a function of the depletion of the liquid from the container to maintain the hydrostatic pressure at the outlet constant during flow of the liquid through the outlet.

8. The dispenser as set forth in claim 7 wherein said support includes at least one spring.

9. The dispenser as set forth in claim 7 including a sensor for sensing the proximity of a user and for actuating said valve in response to proximity of the user.

10. A dispenser for dispensing a liquid at a constant flow rate, said dispenser comprising in combination:

(a) a container for containing the liquid to be dispensed;

(b) a support for supporting the container, said support including a shelf for supporting said container and at least one post in penetrable engagement with said shelf;

(c) an outlet for discharging the liquid;

(d) a conduit for conveying the liquid from said container to said outlet;

(e) a valve for controlling flow of liquid through said outlet; and (f) a weight responsive element for raising said support in proportion to depletion of the liquid from said container to maintain the hydrostatic pressure at said outlet essentially constant irrespective of the degree of fill of said container.

11. The dispenser as set forth in claim 10 wherein said weight responsive element is at least one spring.

12. The dispenser as set forth in claim 10 wherein said weight responsive element is a coil spring disposed about said post.

13. The dispenser as set forth in claim 10 including a sensor for sensing the proximity of a user and for actuating said valve in response to proximity of the user.

14. The dispenser as set forth in claim 10 wherein said container is a flexible container.

15. A. The dispenser as set forth in claim 10 wherein said container is a sealed flexible container.

16. The dispenser as set forth in claim 10 wherein said conduit includes a hollow needle having an apertured end in penetrable engagement with the interior of said container.

17. The dispenser as set forth in claim 10 including a further valve in fluid communication with said conduit for interconnecting said conduit with a source of below ambient pressure to draw the liquid into said conduit from said container to initially fill said conduit with the liquid.

18. The dispenser as set forth in claim 17 including a syringe having a cylinder and a plunger displaceable within said cylinder for engaging said further valve to create the source of below ambient pressure within said conduit upon displacement of said plunger within said cylinder.

19. The dispenser as set forth in claim 18 wherein engagement of said syringe with said further valve results in opening of said further valve and disengagement of said syringe from said further valve results in closing said further valve.

20. A dispenser for dispensing a liquid at a constant flow rate, said dispenser comprising in combination:

(a) a flexible container for containing the liquid to be dispensed;

(b) a support for supporting the container;

(c) an outlet for discharging the liquid;

(d) a conduit for conveying the liquid from said container to said outlet, said conduit including a hollow needle having an apertured end in penetrable engagement with the interior of said container;

(e) a valve for controlling flow of liquid through said outlet;

(f) a sensor for sensing the proximity of a user and for actuating said valve in response to proximity of the user; and (g) a weight responsive element for raising said support in proportion to depletion of the liquid from said container to maintain the hydrostatic pressure at said outlet essentially constant irrespective of the decree of fill of said container.

21. The dispenser as set forth in claim 20 wherein said weight responsive element is at least one spring.

22. The dispenser as set forth in claim 20 wherein said container is a sealed flexible container.

23. The dispenser as set forth in claim 20 wherein said support includes a shelf for supporting said container and at least one post in penetrable engagement with said shelf.

24. The dispenser as set forth in claim 23 wherein said weight responsive element is a coil spring disposed about said post.

25. The dispenser as set forth in claim 20 including a further valve in fluid communication with said conduit for interconnecting said conduit with a source of below ambient pressure to draw the liquid into said conduit from said container to initially fill said conduit with the liquid.

26. The dispenser as set forth in claim 25 including a syringe having a cylinder and a plunger displaceable within said cylinder for engaging said further valve to create the source of below ambient pressure within said conduit upon displacement of said plunger within said cylinder.

27. The dispenser as set forth in claim 26 wherein engagement of said syringe with said further valve results in opening of said further valve and disengagement of said syringe from said further valve results in closing said further valve.

28. A dispenser for dispensing a liquid at a constant flow rate, said dispenser comprising in combination:

(a) a container for containing the liquid to be dispensed;

(b) a support for supporting the container;

(c) an outlet for discharging the liquid;

(d) a conduit for conveying the liquid from said container to said outlet;

(e) a valve for controlling flow of liquid through said outlet;

(f) a further valve in fluid communication with said conduit for interconnecting said conduit with a source of below ambient pressure to draw the liquid into said conduit from said container to initially fill said conduit with the liquid; and (g) a weight responsive element for raising said support in proportion to depletion of the liquid from said container to maintain the hydrostatic pressure at said outlet essentially constant irrespective of the degree of fill of said container.

29. The dispenser as set forth in claim 28 including a syringe having a cylinder and a plunger displaceable within said cylinder for engaging said further valve to create the source of below ambient pressure within said conduit upon displacement of said plunger within said cylinder.

30. The dispenser as set forth in claim 29 wherein engagement of said syringe with said further valve results in opening of said further valve and disengagement of said syringe from said further valve results in closing said further valve.

31. The dispenser as set forth in claim 28 wherein said weight responsive element is at least one spring.

32. The dispenser as set forth in claim 28 wherein said support includes a shelf for supporting said container and at least one post in penetrable engagement with said shelf.

33. The dispenser as set forth in claim 32 wherein said weight responsive element is a coil spring disposed about said post.

34. The dispenser as set forth in claim 28 including a sensor for sensing the proximity of a user and for actuating said valve in response to proximity of the user.

35. The dispenser as set forth in claim 28 wherein said container is a flexible container.

36. The dispenser as set forth in claim 28 wherein said conduit includes a hollow needle having an apertured end in penetrable engagement with the interior of said container.

37. The dispenser as set forth in claim 28 wherein said container is a sealed flexible container.

* * * * *